US007661473B2

(12) United States Patent
Garcia

(10) Patent No.: US 7,661,473 B2
(45) Date of Patent: Feb. 16, 2010

(54) EXPANSION ENHANCEMENT DEVICE

(75) Inventor: David A. Garcia, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 144 days.

(21) Appl. No.: 11/685,515

(22) Filed: Mar. 13, 2007

(65) Prior Publication Data

US 2008/0226425 A1 Sep. 18, 2008

(51) Int. Cl.
*E21B 23/02* (2006.01)
*E21B 23/00* (2006.01)
*E21B 19/00* (2006.01)

(52) U.S. Cl. ..... 166/206; 166/207

(58) Field of Classification Search ..... 166/384, 166/207, 237, 206

See application file for complete search history.

(56) References Cited

U.S. PATENT DOCUMENTS

| | | | | |
|---|---|---|---|---|
| 529,831 | A | 11/1894 | Peckham et al. | |
| 760,914 | A | 5/1904 | Newberry | |
| 1,332,626 | A | 3/1920 | Henegar | |
| 1,558,364 | A | 10/1925 | Iverson | |
| 1,662,411 | A | 3/1928 | Bonat et al. | |
| 1,777,614 | A | 10/1930 | Hauger | |
| 2,225,031 | A | 12/1940 | Caldwell | |
| 2,358,606 | A | 9/1944 | Summers | |
| 2,450,425 | A | 10/1948 | Frisby | |
| 2,860,540 | A | 11/1958 | Karlsson | |
| 3,162,084 | A | 12/1964 | Wurzel | |
| 3,495,496 | A | 2/1970 | Keim | |
| 4,274,323 | A | 6/1981 | Resnicow | |
| 5,836,367 | A | 11/1998 | Calabrese | |
| 6,012,523 | A * | 1/2000 | Campbell et al. | 166/277 |
| 6,488,461 | B1 | 12/2002 | Zacharias et al. | |
| 7,011,482 | B2 | 3/2006 | Underwood et al. | |
| 7,017,669 | B2 * | 3/2006 | Johnston et al. | 166/382 |
| 2002/0070503 | A1 * | 6/2002 | Zimmerman et al. | 277/337 |
| 2004/0090068 | A1 * | 5/2004 | Evans et al. | 285/382 |
| 2006/0266516 | A1 * | 11/2006 | Presslie et al. | 166/206 |

OTHER PUBLICATIONS

Moore, Melvin J., et al., "A Method for Isolating Pressure-Depleted Zones with Solid Expandable Tubulars", SPE 81095, 2003, 1-8.
Dupal, Kenneth K., et al., "Solid Expandable Tubular Technology—A Year of Case Histories in the Drilling Environment", SPE/IADC 67770, 2001m 1-16.
Wright, Jon C., et al., "Expandable Tubular Casing Repairs: Four Case Histories", SPE 84049, 2003, 1-10.
Storaune, Anders, et al., "Versatile Expandables Technology for Casing Repair", SPE/IADC 92330, 2005, 1-8.

* cited by examiner

*Primary Examiner*—David J Bagnell
*Assistant Examiner*—Catherine Loikith
(74) *Attorney, Agent, or Firm*—Steve Rosenblatt

(57) ABSTRACT

Nested articulated split rings move relatively to each other to enlarge their outer dimension for a grip on a surrounding tubular or the wellbore. The rings can be articulated to enlarge their outside dimension with relative movement that can be initiated by dimensional expansion from within the tubular or manipulation of the tubular that creates the desired relative movement. The relative movement can be locked in after it is made to secure the grip. Different shape profiles that magnify the radial outer dimension in excess of the percentage dimensional change in the underlying tubular are contemplated.

22 Claims, 3 Drawing Sheets

EXPANSION ENHANCEMENT DEVICE

FIELD OF THE INVENTION

The field of the invention relates to tubulars that are expanded and more particularly the use of an external device to increase the final reach of the expansion.

BACKGROUND OF THE INVENTION

There are limits to the amount of expansion a tubular can withstand and still remain structurally sound. Some applications require more significant expansions for example where a hanger or a packer has to go through tubing and be expanded into larger casing below.

Rather than accepting limitations on the percentage expansion that a tubular can tolerate, the present invention seeks a way to affix a tubular to a surrounding tubular using an articulated device on the exterior of the tubular to enhance its reach to a surrounding tubular without exceeding its reasonable expansion capabilities. In some embodiments the extension into a supportive or sealing relation with a surrounding tubular can be accomplished even without internal expansion of the tubular itself and exclusively with an exterior articulated device that can be actuated by manipulation of the tubular within.

Of marginal relevance to the present invention are split washers that can be closed over a bolt or shaft without having to remove it. These designs are generally two pieces that snap over a shaft and some that lock upon being snapped. Examples of such designs are U.S. Pat. Nos. 1,558,364; 1,777,614; 2,358,606 and 6,488,461. However, none of these designs accommodate expansion of the structure within or a supporting or sealing engagement about their exterior. Those skilled in the art will appreciate the various aspects of the invention from the description of the preferred embodiment and the associated drawings while recognizing that the full scope of the invention is given by the associated claims.

SUMMARY OF THE INVENTION

Nested articulated split rings move relatively to each other to enlarge their outer dimension for a grip on a surrounding tubular or the wellbore. The rings can be articulated to enlarge their outside dimension with relative movement that can be initiated by dimensional expansion from within the tubular or manipulation of the tubular that creates the desired relative movement. The relative movement can be locked in after it is made to secure the grip. Different shape profiles that magnify the radial outer dimension in excess of the percentage dimensional change in the underlying tubular are contemplated.

BRIEF DESCRIPTION OF THE DRAWINGS

FIG. 3 is a close up view of the nested rings of FIG. 1 in the retracted position for run in;

DETAILED DESCRIPTION OF THE PREFERRED EMBODIMENT

Figure 1:
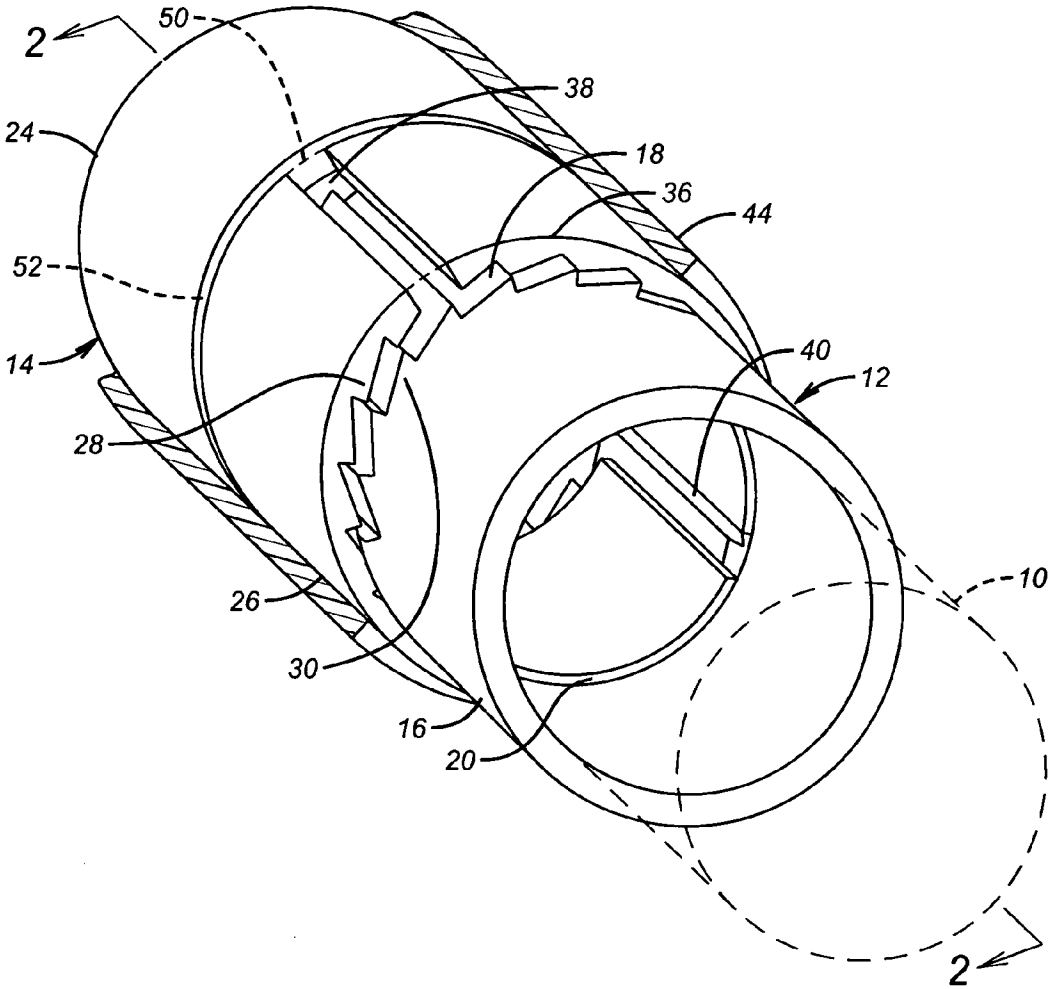
FIG. 1 is a perspective view of the exterior assembly mounted on a tubular and in the extended position.
Figure 2:
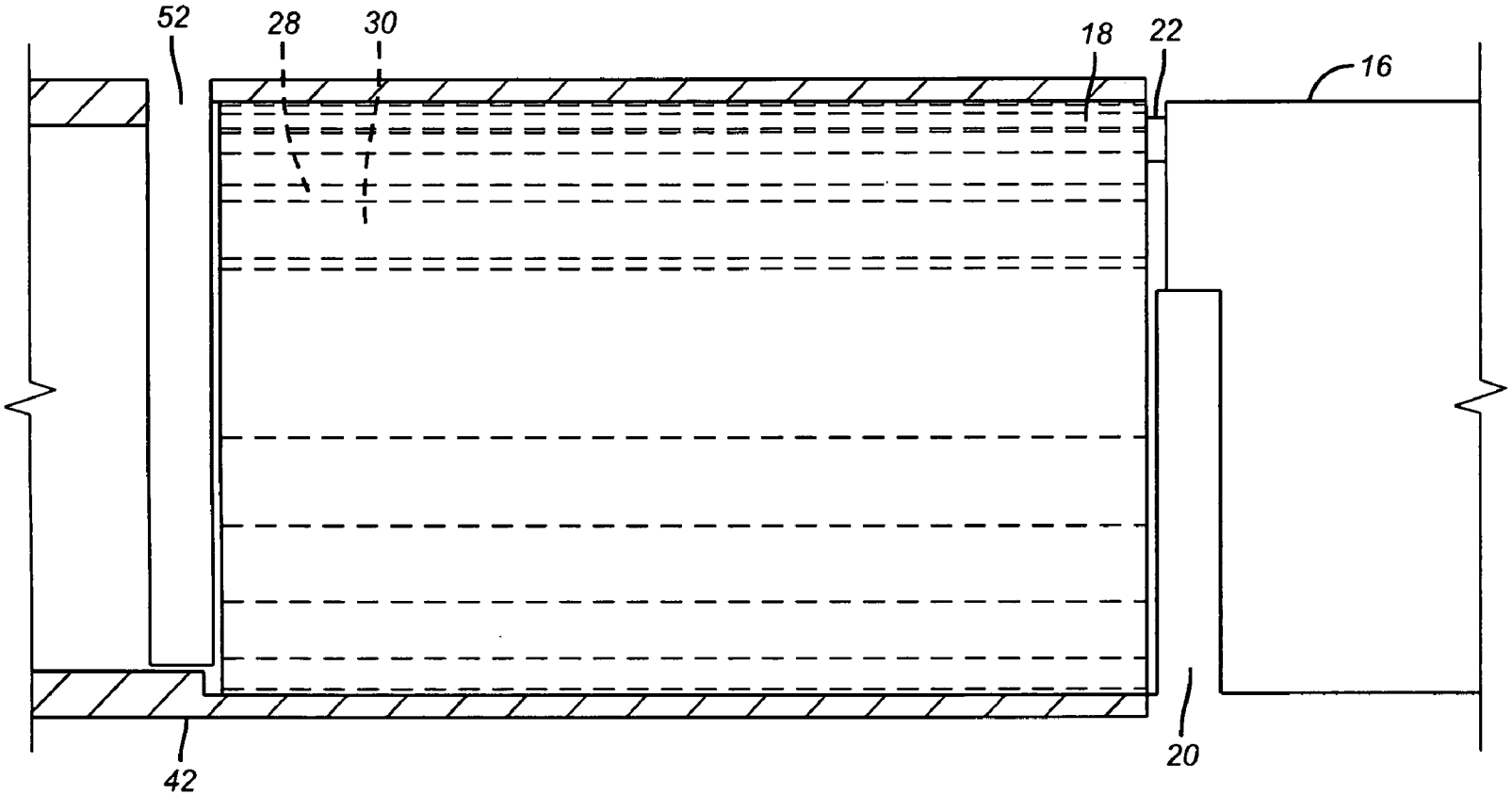
FIG. 2 is a view along lines 2-2 of FIG. 1 with the outer seal removed for cliarity.
Figure 4:
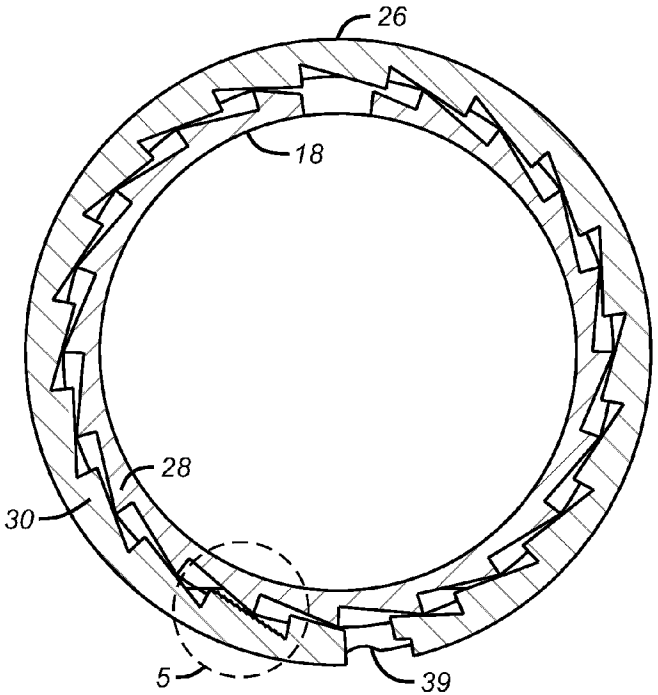
FIG. 4 is a section view at 90 degrees to section 2-2 of FIG. 1.
Figure 3:
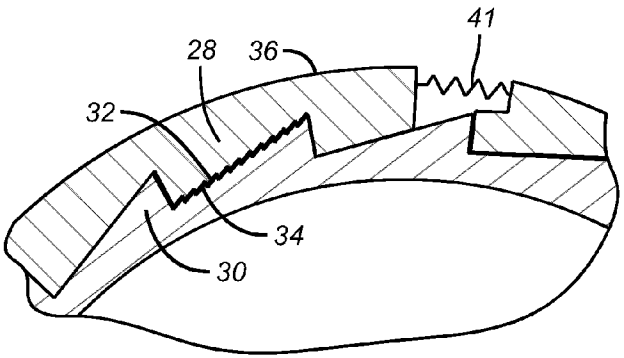
Figure 5:
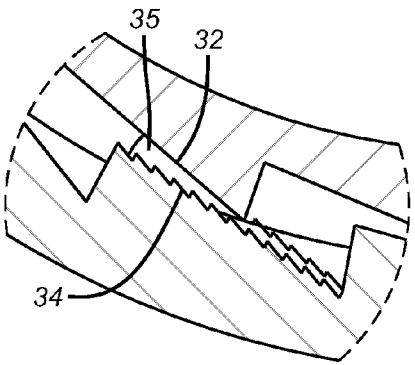
FIG. 5 is an enlarged view within circle 5 in FIG. 4.

FIG. 1 schematically illustrates a tubular 10 that has mounted on its exterior an inside ring assembly 12 and an overlapping outside ring assembly 14. Optionally, the inside ring assembly 12 can be integrated into tubular 10 or a separate structure. The inside ring assembly 12 has a smooth walled component 16 and outer serrated component 18. The two components are circumferentially gapped as shown by gap 20 in FIG. 2 but they are still attached to each other for some portion of their periphery as indicated at 22 in FIG. 2. The outside ring assembly 14 is configured mostly the same as the inside ring assembly 12 in that it has a smooth walled component 24 and an inner serrated component 26. Serrations 28 are on the inner serrated component 26 and serrations 30 are on the outer serrated component. For run in, the serrations 28 and 30 are preferably in a nested arrangement such as shown for a saw tooth arrangement illustrated in FIG. 3. FIG. 3 also shows an optional roughening of opposed surfaces 32 and 34 shown for example along an exemplary saw tooth with those skilled in the art realizing that the surface treatment can exist on one of two opposing surfaces 32 and 34 or on both, as shown. The individual surface serration can be applied over the entire circumference or on selected mating surfaces around the circumference. Alternatively and intermediate lock ring 35 can be placed between components 18 and 26 and can operate like a ratchet body lock ring used in weight set packers to allow relative movement in one direction and oppose it in the opposite direction.

While a saw tooth pattern is illustrated that is at a minimum outside diameter 36, as shown in FIG. 3, other patterns that can nest and then upon relative movement cause component 26 to climb up on component 18 that is under it are fully contemplated. To make this phenomenon easier to accomplish and to avoid increasing resistance to an expansion force applied from within tubular 10, mating components 18 and 26 are preferably both split and the splits are preferably circumferentially offset. FIG. 1 illustrates a split 38 in component 26 offset from split 40 in component 18. While splits 38 and 40 can't be seen in FIG. 2 they preferably occur respectively about 180 degrees circumferentially spaced from attachments 42 and 22. As an alternative to splits 38 and 40 components 18 and 26 can have no splits and instead have a weakened portion that does not resist expansion very much such as a thin walled portion 39 or a portion with folded segments 41 that stretch out as the rest of the structure is expanded or a portion made of a resilient material. In these instances a separate seal element can be omitted.

The operation of the device increases the circumference 36 as the tubular 10 is expanded in a known manner. Rather than simply increasing the outside diameter of a tubular such as 10 from expansion, the use of the present invention allows the expansion of the underlying tubular 10 to be amplified. This happens as radial expansion of component 18 with the tubular 10 allows teeth 30 to move relative to teeth 28 with the result being an opening of the gap 38 wider as circumference 36 increases. Using surface roughening as illustrated in FIG. 3 the tendency to spring back is resisted. It is clear that the expanded tubular 10 will continue to act against components 18 and 26 to push them into the surrounding tubular. With the use of the present invention, the end diameter of the assembly is enhanced due to the formerly nested components 28 and 30 climbing up on each other to enhance the expanded diameter 36 toward the surrounding tubular.

The nested components can have any shape including discrete projections on a predetermined pattern and elongated ridges that are sinusoidal in section to be nested when in phase and additionally extended when placed out of phase with a maximum occurring when they are 90 degrees out of phase, for example.

While the outer circumference 36 can be what comes in contact with the surrounding tubular, a seal 44 can overlay assembly 14 preferably at component 26. The seal 44 can take the form of a sleeve compatible with well conditions and resilient to form a seal. A material that swells with exposure to well fluids can also be used for seal 44. As an alternative actuation mode, a material 44 that is not necessarily a seal but that drags on the surrounding tubular at run in can be used. The intent is that by such dragging it resists rotation of assembly 14 as assembly 12 is rotated, rather than expanded to cause relative movement between teeth 28 and 30 to fixate the tubular 10.

While components 16 and 24 have been shown as complete tubes, they too can be split preferably 180 degrees opposed from their respective attachment points at 22 and 42. The inner component 12 can be loosely secured against longitudinal movement with respect to tubular 10 or it may be more permanently secured to it. The construction materials for the inner and outer components must be able to tolerate the compressive loading placed on them when actuated against the wellbore or the surrounding tubular and can be metallic, non-metallic, composites or other durable materials.

Optionally, components 12 and 14 may comprise only overlapping segments 18 and 26 with inner segment 18 secured or loosely mounted to tubular 10.

The above description is illustrative of the preferred embodiment and many modifications may be made by those skilled in the art without departing from the invention whose scope is to be determined from the literal and equivalent scope of the claims below.

I claim:

1. An apparatus for enhancing the increase in the outer diameter of a tube assembly in a wellbore as a result of expansion from within the tube, comprising:

an inner component supported by or integral to said tube and having an outer surface;

an outer component mounted over said inner component and having an inner surface and a wellbore facing surface;

said outer component radially movable relatively to said inner component to further increase the circumference of said outer component beyond the increase it experiences from radial expansion from within the tube in the wellbore.

2. The apparatus of claim 1, wherein:

said inner component moves radially.

3. The apparatus of claim 2, wherein:

said inner and outer surfaces each comprise at least one projection.

4. The apparatus of claim 3, wherein:

said projections are nested in one position defining a minimum circumference of said wellbore facing surface, said projections selectively relatively move toward alignment to increase the circumference of said wellbore facing surface.

5. The apparatus of claim 3, wherein:

at least one of said projections comprises a surface irregularity to allow relative movement in one direction and resist it in an opposite direction.

6. The apparatus of claim 1, wherein:

said inner component is rotated with respect to said outer component.

7. The apparatus of claim 1, wherein:

said inner and outer surfaces are aligned.

8. The apparatus of claim 1, wherein:

at least one of said components are longitudinally split.

9. The apparatus of claim 8, wherein:

both said components are longitudinally split.

10. The apparatus of claim 9, wherein:

said splits are circumferentially offset.

11. The apparatus of claim 1, wherein:

said inner and outer surfaces have matching patterns of projections that radially separate said components when said projections are moved from a nested toward an aligned position.

12. The apparatus of claim 11, wherein:

said patterns comprise spaced sloping surfaces such that radial expansion of said inner component causes translation between pairs of contacting sloping surfaces.

13. The apparatus of claim 12, wherein:

said patterns extend the available circumference of said components.

14. The apparatus of claim 13, wherein:

said components are longitudinally split.

15. The apparatus of claim 14, wherein:

said splits are circumferentially offset from each other.

16. The apparatus of claim 12, wherein:

at least one of said sloping surfaces has a surface treatment that allows relative motion in one direction and resists it in an opposed direction.

17. The apparatus of claim 12, wherein:

a lock ring is interposed between said components to allow relative movement between said sloping surfaces in one direction and resist such relative movement in the opposite direction.

18. The apparatus of claim 11, wherein:

said patterns of projections define an undulating profile when viewed in an axial direction.

19. The apparatus of claim 1, wherein:

said wellbore facing surface further comprises a seal.

20. The apparatus of claim 19, wherein:

said seal swells downhole.

21. The apparatus of claim 1, wherein:

at least one of said components are not split.

22. The apparatus of claim 21, wherein:

at least a portion of the circumference of at least one of said components is either made of a resilient material, made of the same material but is weaker or thinner than the remaining circumference or is made of one or more folds that unfold during expansion.

* * * * *